US007367105B2

(12) United States Patent
Bogers

(10) Patent No.: US 7,367,105 B2
(45) Date of Patent: May 6, 2008

(54) METHOD AND DEVICE FOR GALVANIZING OBJECTS

(75) Inventor: Jacobus Maria Mathijs Bogers, AP Budel (NL)

(73) Assignee: Galva Solutions, B.V., PX Maarheeze (NL)

( * ) Notice: Subject to any disclaimer, the term of this patent is extended or adjusted under 35 U.S.C. 154(b) by 0 days.

(21) Appl. No.: 10/501,859

(22) PCT Filed: Jan. 15, 2003

(86) PCT No.: PCT/NL03/00025

§ 371 (c)(1),
(2), (4) Date: Aug. 1, 2005

(87) PCT Pub. No.: WO03/060177

PCT Pub. Date: Jul. 24, 2003

(65) Prior Publication Data

US 2005/0268996 A1 Dec. 8, 2005

(30) Foreign Application Priority Data

Jan. 16, 2002 (NL) ..... 1019751
May 27, 2002 (NL) ..... 1020689
Dec. 3, 2002 (NL) ..... 1022066

(51) Int. Cl.
*B21B 1/42* (2006.01)

(52) U.S. Cl. ..... 29/564; 29/527.4; 29/527.2; 451/82; 427/239; 427/433; 427/310; 427/321

(58) Field of Classification Search ..... 29/564, 29/527.4, 527.2, 90.7, DIG. 36; 451/82, 451/83, 89, 331; 427/239, 433, 310, 321
See application file for complete search history.

(56) References Cited

U.S. PATENT DOCUMENTS 2,584,647 A * 2/1952 Webber ..... 451/89
2,852,410 A 9/1958 Brewer
3,495,720 A 2/1970 Mann, Jr. et al.

(Continued)

FOREIGN PATENT DOCUMENTS

DE 2004 633 5/1983

(Continued)

OTHER PUBLICATIONS

International Search Report of PCT/NL03/00025, dated May 23, 2003.

(Continued)

*Primary Examiner*—Dana Ross
(74) *Attorney, Agent, or Firm*—Christie, Parker & Hale, LLP

(57) ABSTRACT

A device and method for thermally galvanizing objects, in particular metal objects, includes pretreating an object for treating. The pretreated object is arranged in a flux bath for fluxing of the object and arranged in a zinc bath in order to have the material of the object react with zinc and to apply a zinc-containing layer to the object. The pretreating includes blasting the object with grains so as to remove at least the surface layer.

10 Claims, 5 Drawing Sheets

U.S. PATENT DOCUMENTS

| | | | |
|---|---|---|---|
| 3,813,817 | A | 6/1974 | Häberlin |
| 3,824,737 | A | 7/1974 | Janson |
| 5,666,714 | A | 9/1997 | Height et al. |

FOREIGN PATENT DOCUMENTS

| | | |
|---|---|---|
| EP | 0 252 294 | 1/1988 |
| FR | 2 374 141 | 7/1978 |
| JP | 58151463 | 9/1983 |
| JP | 60211058 | 10/1985 |
| JP | 60230971 | 11/1985 |
| JP | 01047842 | 2/1989 |
| JP | 06115688 | 4/1994 |
| JP | 06330273 | 11/1994 |
| JP | 06346281 | 12/1994 |
| SU | 648 653 | 2/1979 |
| SU | 1738622 A1 | 6/1992 |

OTHER PUBLICATIONS

European Patent Office communication dated Dec. 22, 2005, for EP 03 729 565.6.

* cited by examiner

METHOD AND DEVICE FOR GALVANIZING OBJECTS

CROSS-REFERENCE TO RELATED APPLICATION

This application is a National Phase Patent Application of International Application Number PCT/NL03/00025, filed on Jan. 15, 2003, which claims priority of Netherlands Patent Application Number 1019751, filed on Jan. 16, 2002, Netherlands Patent Application Number 1020689, filed on May 27, 2002, and Netherlands Patent Application Number 1022066, filed on Dec. 3, 2002.

FIELD

The present invention relates to a method and device for galvanizing objects, in particular galvanizing metal objects.

BACKGROUND

A number of techniques are known for the protection of steel constructions from the effect of corrosion. One known technique is hot dipping galvanizing, wherein a thin layer of zinc is applied to the object surface. The applied zinc layer provides the object with a cathodic protection, i.e. in the case of corrosion zinc is relinquished and thus protects the underlying metal. The corrosion products of zinc will moreover fill up possible damage such as scratches and the like, whereby an additional protection is obtained.

The zinc can be deposited by electrochemical means onto the object, a process known as electrolytic galvanization. Alternatively, the zinc can be applied to the metal object by spraying zinc onto the surface of the object using spray guns (zinc-spraying), by having zinc diffuse in a drum (sherardizing) or by painting the zinc onto the object (referred to as zinc dust painting or cold-galvanizing). A further option for applying zinc to a metal is thermal galvanizing, wherein the object for treating is immersed in liquid zinc located in a zinc bath at temperatures between 445° C. and 465° C.

In thermal galvanizing the object for treating undergoes a pretreatment in which dirt, oil and fat residues are removed from the object surface. As pretreatment the object is then placed in a bath with a diluted hydrochloric acid solution and pickled therein so as to remove rust and mill scale. There then follows a "flux" treatment in which the object for treating is arranged in a flux bath with for instance zinc ammonium chloride so as to later obtain a good adhesion of the zinc to the steel. If the flux is first applied and then dried, this is known as dry galvanizing. In wet galvanizing, the flux is spread over the zinc bath surface and the steel is pulled therethrough. After the treatment there is formed on the steel surface an entity of zinc/iron alloy layers. After said pretreatment the object is immersed, in accordance with the known method, for some minutes in the zinc bath where the liquid zinc bonds to the steel, this over the entire surface thereof and therefore also on the inside of possible hollow structures in the object. During the immersion a number of (gamma, delta and eta layer) alloy layers are formed through reaction of zinc with metal, while a layer of pure zinc is formed when the object is taken out of the zinc bath.

A number of drawbacks are associated with the known methods. Firstly, the use of chemical baths such as hydrochloric acid baths as pretreatment of the steel has an environmental impact. In addition, the supply of hydrochloric acid and the discharge of (contaminated) hydrochloric acid entails high costs.

The known method further involves a number of labour-intensive and relatively costly steps, such as the arranging of the steel in degreasing baths, pickling baths and possible dezincification baths in the case of reconditioning of steel once galvanized in the past. The hydrochloric acid only removes the mill scale from the object and further impurities remain present on the object surface. Additional processing steps are hereby necessary.

A further drawback of the known method and device is that the use of hydrochloric acid results in brittleness of the treated metal. Subsequent galvanizing of the brittle metal will therefore produce a less smooth surface, which adversely affects the appearance of the galvanized product.

Known from the American document U.S. Pat. No. 5,666,714 is a method for galvanizing steel components. The components are first shot-blasted and are then formed and/or welded into an object. The thus formed and/or welded object undergoes, among others, a flux treatment and a galvanizing treatment. A drawback of the known method is that prefabricated and/or used objects first have to be taken apart into their individual components to enable the start of pretreatment of the components.

OBJECT

An object of the invention is to obviate at least one of the above stated drawbacks and to provide an improved method, system and device for treating objects with a protective material.

It is another object of the invention to provide an advantageous device with which objects for galvanizing can be pretreated.

SUMMARY

One or more of these objects can be met with various embodiments of the invention. According to a first embodiment of the invention, a method is provided for thermally galvanizing objects, in particular metal objects. The method includes pretreating an object for treating, including removing the surface layer from the object. The pretreated object is arranged in a flux bath, and the arranged in a zinc bath in order to have the material of the object react with zinc and to apply a zinc-containing layer to the object. In this embodiment, pretreating includes blasting the object with grains so as to remove at least the surface layer. In this embodiment, the prior art pretreatment steps of optional dezincification, degreasing, treatment with hydrochloric acid and cleaning with water and the like can therefore be replaced by a single step, i.e. shot-blasting of the object. Not only is the mill scale here removed from the object, but it is also possible, as desired, to remove multiple material layers, such as the silicon layer, from the object. This produces a cleaner surface of the object, which surface requires a smaller quantity of zinc for the purpose of galvanization. The thus treated object is further more suitable for the application thereto of a coating. The appearance of an object shot-blasted and galvanized in this manner is also more attractive.

The method according to this embodiment is further directly applicable to prefabricated objects and to already used objects. The objects can herein be treated immediately without additional steps such as dismantling and the like therein being necessary.

It has been found that particles or grains with an average diameter of between 0.25 and 1.6 mm and manufactured from steel with a low carbon content are particularly suitable for shot-blasting the objects. The grains have a low carbon content since, with a high carbon content, too thick a zinc layer is deposited onto the object and the degree of hard zinc formation increases. In one embodiment, a mixture is applied of substantially 40% with a grain size of 0.6-1.0 mm and 60% with a grain size of 0.8-1.3 mm. This makes possible an optimal ratio between toughness, minimum grain use and maximum effect. A large ricochet/bounce effect also occurs which increases the effectiveness of the shot-blasting, and particularly the blasting of the parts of the object which are relatively difficult to reach.

It is deemed known to immerse an object for treating in a bath, to subsequently hold it stationary in the bath for a few minutes and then remove it from the bath. It is then the turn of the following object. According to a further exemplary embodiment of the invention however, the above stated step of arranging the object in at least one of the baths comprises of having the object move through the bath in question. This means that one object after another can be transported continuously or in substantially uninterrupted manner through the bath. This not only makes possible the use of a device as according to one embodiment of the invention to be mentioned below, but also influences chemical processes which occur during the galvanization. This immersion or plunging of the objects into a bath influences the occurring chemical processes in negative manner. By moving the objects though the bath there is less ash formation and, in particular, less vapour formation. There is moreover a smaller chance of loss-making formation of hard zinc iron/zinc crystals.

In one embodiment, an object is transported through the bath at a practically constant speed in order to bring about a uniform galvanization of the object which is as constant as possible.

According to another embodiment of the invention, a device is provided for shot-blasting objects, in particular metal objects, including a housing with at least an entrance opening and exit opening for respectively supplying and discharging the objects for shot-blasting. This embodiment also includes displacing means for displacing the objects for shot-blasting in a path through the housing from the entrance opening to the exit opening. Shot-blasters are also which are disposed on both sides along the path in the housing and are oriented differently in relation to the housing, and which hurl streams of grains at an object in a number of different blasting directions for the purpose of removing a surface layer from the object over substantially the whole surface thereof. The shot-blasters in this embodiment therefore can direct grains simultaneously to at least the front and the rear of the object at different angles, so that the grains strike the object all along its surface. In one embodiment, eight shot-blasters are placed and directed such that all those parts of the objects for processing which have to reached can be reached.

In one embodiment, the displacing means includes a beam extending along the route, and one or more suspension elements which can be fixed to the beam and from which the objects for displacing can be suspended. The displacing means also includes a drive means for displacing the suspension elements along the beam, a first guide element placed on a first side along the route, and a second guide element placed on an opposite side along the route. The mutual distance between the first and second guide element is adjusted to the dimensions of the object. In another embodiment, a suspension element engages on the top side of an object and the guide elements are disposed to limit the transverse displacement of the underside of the object. The guide means in this embodiment can ensure that, despite the great forces exerted on the objects by the shot-blasters, as a result of which the objects could be blown into an askew position, the objects remain in an upright orientation in the correct manner. This ensures a uniform removal of the surface layer from the objects. Application of the beam (preferably in the form of an overhead track) along which the objects are transported continuously during the treatment process (galvanizing process) furthermore enables the process to be fully automated, or at least to a large extent. This allows better control of the different process steps, while less personnel is required.

In a further embodiment, the device is suitable for shot-blasting objects of different dimensions and forms. This embodiment is adapted for fixing of the guide elements at different intermediate distances, depending on the dimensions of the object. In the case of relatively large objects or objects with protruding parts, a large intermediate distance is opted for, while in the case of relatively small objects the intermediate distance can be small.

A distance of less than 30 cm is preferably kept between the object and the guide element. If the form of the object permits, an even smaller distance is chosen, such as, for instance, 10 cm.

In another embodiment, the dimensions of the entrance and exit opening are adjustable. In the case of large objects a relatively large opening is necessary, while a relatively small opening can suffice for small objects. Making the openings larger and smaller can take place by providing the housing with a number of doors slidable relative to each other. The entrance opening is, for example, formed by two sliding doors between which the opening is defined. The opening is chosen such that the relevant object can enter or leave the housing through the opening. This limits the quantity of grains released during the shot-blasting, which enhances the treatment of the object. Grains escaping from the housing (blasting cabinet) can after all enter the flux baths or zinc baths, and thus adversely affect the fluxing or galvanizing process.

A further embodiment includes first detection means positioned close to the entrance opening with which the dimensions of the following object for shot-blasting can be determined, in addition to control means which are coupled to the detection means and with which the size of the entrance opening and exit opening can be set subject to the detected object size. An automatic adjustment of the size of the entrance opening and/or exit opening can hereby be realized.

A further embodiment includes second detection means for detecting an object hanging from one of the suspension elements, in addition to control means for controlling the drive means of the overhead track and at least the shot-blasters in order to interrupt the driving of the suspension element and the shot-blasters with a predetermined time delay. When for instance one or more detection eyes detect that the supplied suspension elements no longer contain any objects for treating, the control means can then determine when the blasting process must be ended on the basis of the transport speed, known in advance, of the suspension elements. It is furthermore possible to determine when the last object has been fully processed. At that moment the driving of the overhead track is also ended.

According to another embodiment of the invention, there is provided a system for thermally galvanizing objects, in particular metal objects, including an overhead track provided with suspension elements from which one or more objects for treating can be suspended, in addition to drive means for displacing the suspension elements along the overhead track, wherein there are disposed along the overhead track at least: shot-blasters for hurling one or more streams of grains in the direction of an object being displaced therealong for the purpose of removing at least the surface layer from the object; a flux bath for fluxing the object displacing through the bath; and a galvanizing bath for thermally galvanizing the object displacing through the bath. The shot-blasting of the objects instead of degreasing, hydrochloric acid treatment and cleaning with water can provide at least one of the above described advantages. Furthermore, the overhead track along which the objects are transported continuously during the galvanization process allows the galvanization process to be automated fully, or at least to a large degree. This enables a better control of the different process steps, while up to 80% less personnel is required.

According to another embodiment, the overhead track is embodied with at least one descending part and at least one ascending part for respectively carrying the objects downward into a bath and upward out of the bath. A substantially constant treatment of the objects in the flux bath and/or the zinc bath is hereby possible with a relatively simple construction.

According to a further aspect of the invention a suspension element is provided, preferably the above mentioned suspension element, which is manufactured from an alloy such that substantially no zinc is absorbed or adheres to the surface of the element. When a suspension element is guided along the zinc bath, zinc could otherwise be left on the surface of the suspension element. In the processing of a following object this can result in explosions, particularly during shot-blasting of this object, which can cause a hazard for men and machines. An explosion can occur in the system if zinc residues mix with steel grains of another composition (metals).

Further advantages, features and details of the present invention will be elucidated on the basis of the following description of an exemplary embodiment thereof.

BRIEF DESCRIPTION OF THE DRAWINGS

Reference is made in the description to the annexed figures, in which.

DETAILED DESCRIPTION OF EXEMPLARY EMBODIMENTS

Figure 1:
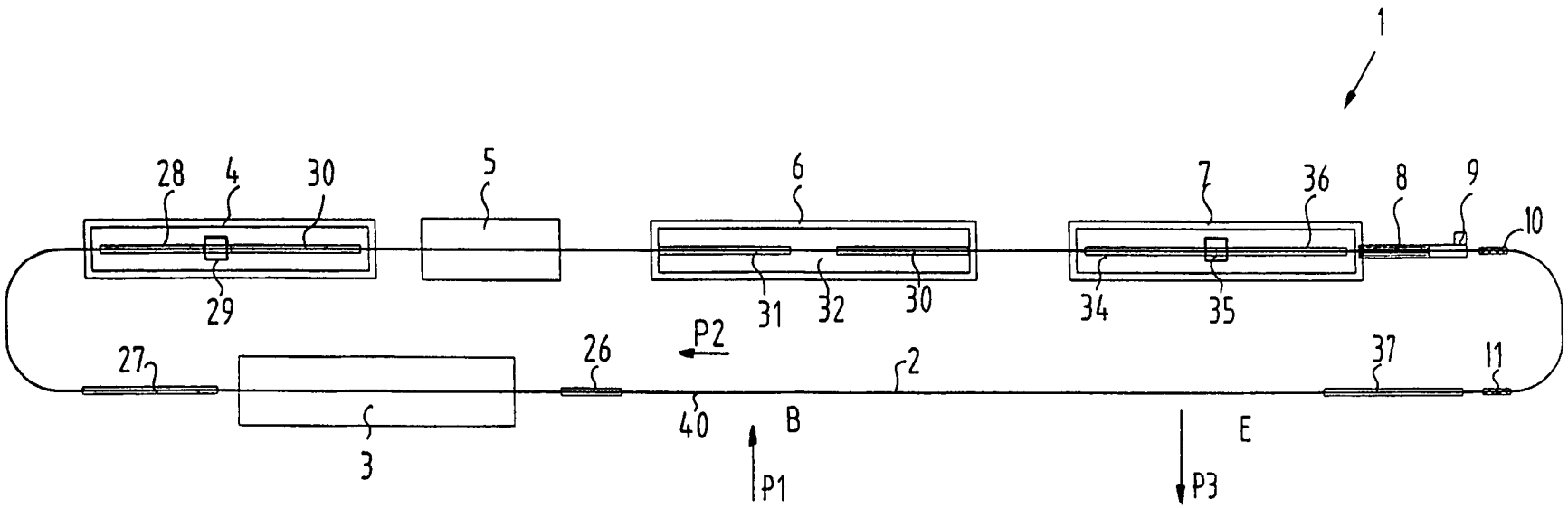
FIG. 1 shows a schematic top view of a first embodiment of the invention.
Figure 2A:
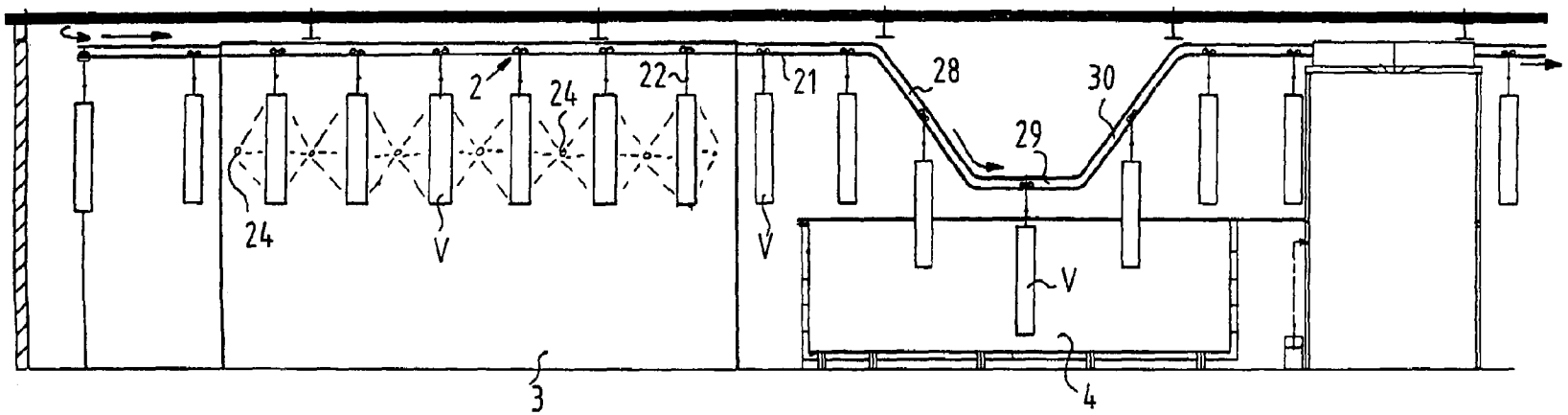
FIG. 2*a* shows a first schematic side view of the embodiment of FIG. 1.
Figure 2B:
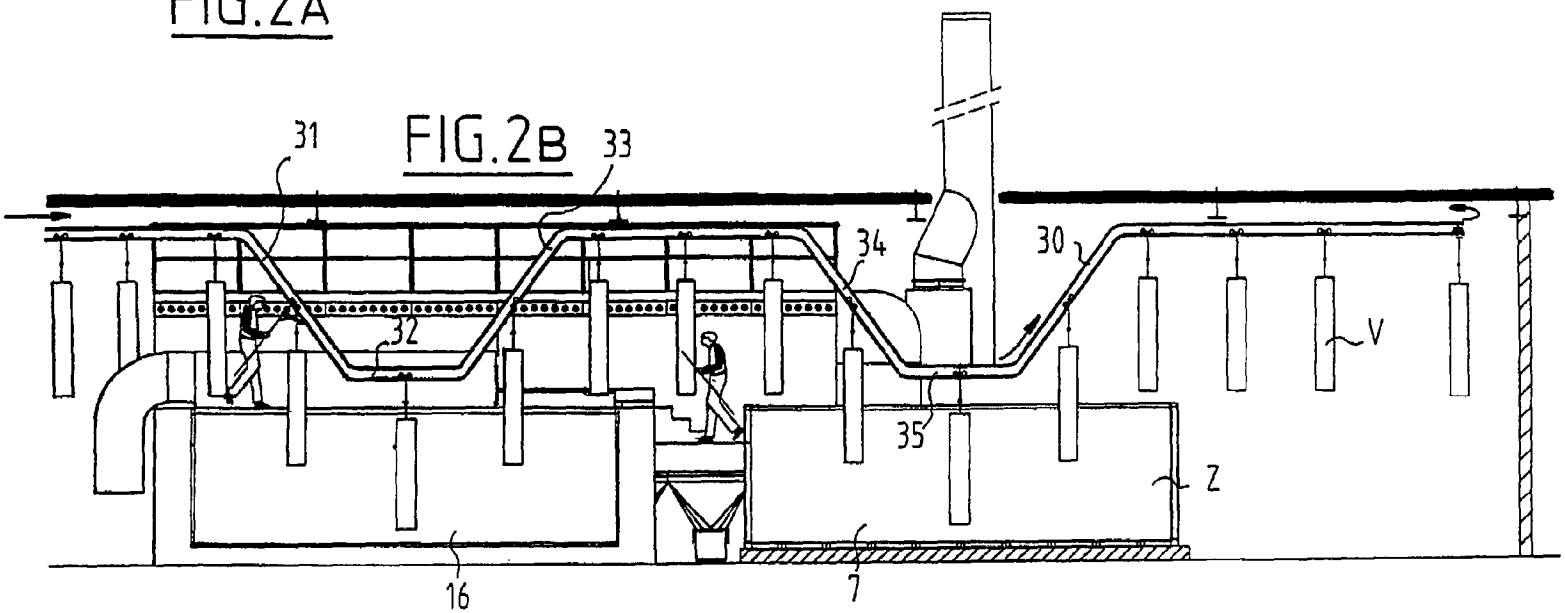
FIG. 2*b* shows a second schematic side view of the embodiment of FIG. 1.

FIGS. 1, 2*a* and 2*b* show an exemplary embodiment of a galvanizing device 1 according to the invention. The objects for galvanizing V, such as for instance steel sections, are supplied and coupled at a starting position to a transport system. The transport system is an overhead track system in the shown embodiment and comprises a chain box rail 2 along which, using rollers 21 (FIG. 2*a*), a number of (for instance about 100) suspension elements 22 can be displaced at an intermediate distance of about 60 cm. Such a chain box rail system can be of a conventional type and will not be discussed here in detail. Other transport systems can also be envisaged.

The suspension elements 22 are advanced by a drive 8 connected to an electrical drive motor 9. Transport system 2 is provided with two tensioning elements 10 and 11 in order to place the system permanently under a determined tension.

Once the objects for treating V have been fastened to suspension elements 22 at starting point B (arrow $P_1$), for instance by hooking the objects thereto, the suspension elements 22 are transported in the direction of arrow $P_2$.

The untreated object V first undergoes a shot-blasting treatment in a blasting cabinet 3. Objects are shot-blasted in the blasting cabinet 3 by means of a number of shot-blasters 24 disposed at a preset angle. The blasting angle at which the objects are blasted can affect the surface layer removal, as well as the grain diameter and the material of the grains. It has been found that an optimum removal of the surface layer from the object can be achieved with the use of steel grains or other forms of steel particle with a grain thickness of between 0.25 mm and 1.6 mm, and preferably in a ratio of 40% particles with a grain size of 0.6-1.0 mm and 60% particles with a grain size of 0.8-1.3 mm. In some embodiments, the chemical composition of the grains is, for instance, 0.14-0.18% C, 0.65-0.85% Si and 0.35-0.55% Mn.

It is possible to opt for the removal of only the mill scale present on the object. In that case the term "surface layer" is understood to mean only the mill scale of the object in question. If desirable however, more layers can be removed from the object in addition to the mill scale. It is possible, for instance, to remove undesired unevenness from the object so that it acquires a smoother and more attractive appearance.

By shot-blasting the object in the above stated manner it is clean to the extent that it can be "fluxed" immediately without additional operations. The term "flux" relates to the arranging of an object in a flux bath 4 which is, for instance, filled with zinc ammonium chloride. The fluxing agent in this embodiment is substantially smoke-free, i.e. a proportionally small concentration of ammonium chloride, preferably somewhere in the order of 10% $NH_4Cl$ (and about 90% $ZnCl_2$), is applied. The zinc ammonium chloride forms a thin layer on the object which during the subsequent galvanizing process enhances the bonding of zinc to the material of the object. The embodiment shown in FIG. 2*a* fluxes by displacing the object, hanging from a suspension element 22, through a flux bath 4.

In another exemplary embodiment not shown in the figures, immediately after the shot-blasting and before the fluxing, the object is cleaned by first of all blowing it off with air and/or then spraying it clean with water to which chemical additives have optionally been added. Chemical additives can be added to enhance drain-off of the water with the dust which has been left behind, consisting mainly of shot-blasting dust.

Spray cleaning in this embodiment takes place by arranging a number of showers along the conveyor track which remove the final iron residues resulting from the shot-blasting treatment. The mixture of water (optionally with additives) and iron residues is then collected and the iron is removed by applying a magnetic filter. The water can then be reused for spray cleaning. Owing to such a recovery, it can be possible to prevent iron residues from entering the environment, the flux bath and/or zinc bath (to be discussed later), so that these baths need changing less frequently. These are further environmentally-friendly embodiments of the present invention.

As shown in FIGS. 1-2*b*, once the flux layer on the object has dried, for instance by guiding the object along a drying unit 5, the object is guided through a zinc bath 6 which is filled with zinc at a temperature of roughly 453° C. It has been found that at this temperature and at a transporting speed through the zinc bath 6 in the order of magnitude of 50-250 cm per minute, and preferably 80 cm per minute, there is brought about an optimal chemical bonding of the liquid zinc to the material of the object.

The thus formed zinc layer is of complicated structure. In addition to a pure zinc layer on the surface, a number of alloy layers with zinc and iron in differing ratios are also formed between the zinc and the material of the object. The combined layer thickness of these layers can vary between 50 and 150 micrometers in some embodiments.

As the galvanized objects emerge, compressed air is guided in the direction of the objects. This can take place for instance by providing a perforated construction adjacent to the conveyor track and by blowing air with great force through the perforations. Zinc droplets possibly still present on the object are hereby blown off the object. This can be useful if the tolerances in the dimensions of the object are critical, for instance in controlling the fitting of the object. The blown-off zinc droplets are collected and fed back to the zinc bath 6, whereby excess zinc is saved and less zinc is therefore lost during galvanizing.

After undergoing the galvanizing treatment, the objects cool through heat exchange with the environment such as outside air or heat exchange in an (optional) cooling system. In the shown embodiment the cooling system comprises a cooling bath 7 along which the objects can be carried.

In this embodiment, the objects are cooled from about 453° C. to about 85° C. If one or more heat exchangers are applied, a temperature of about 80° C. can be obtained. In the embodiment shown in FIG. 2, the cooling is carried out in a cooling bath 7. Separately of or combined with this cooling bath 7 there can be provided a burnishing bath (not shown) in which brightener is applied over the surface of the galvanized object in order to give the object surface a bright appearance. A combined coolant/brightener is preferably Karizol 2508 from the company Dipl. Ing. Herwig GmbH. Such a brightener has good cooling properties, while it also prevents so-called white rusting and makes for an attractive, highly polished product.

After cooling and optionally being provided with brightener, the object in question is transported until it reaches end point E. Arriving here, the object can be removed from the relevant suspension element 22 and discharged ($P_3$). Since the temperature of the objects is about 85° C. or less, employees can package the treated objects immediately and without problem.

FIGS. 2*a* and 2*b* show a side view of a part of the device. In the shown embodiment the blasting and fluxing take place one immediately after the other, in contrast to the embodiment of FIG. 1. One skilled in the art would understand that additional processing may take place between the blasting and fluxing. As shown in FIG. 2*a*, objects V are shot-blasted with a number of blasting elements or shot-blasters 24 which are positioned such that all corners and holes in the objects can be shot-blasted. Shot-blasting therefore takes place not only on the outside but also on the inside of an internal structure of the object, to the extent at least that this internal structure can be reached from outside.

In FIGS. 1-2*b* can be seen that the rail system 21 of transport system 2 has ascending and descending parts at a number of positions. At the starting point (B), where the objects are fastened to the suspension system, the height of rail 21 above the floor amounts to about 2.3 m. At the position of an ascending part 26 of rail 20 the height increases from 2.3 m to about 3 m, so that shot-blasting of the objects takes place at this height. At part 27 there is then a further rise from 3 m to about 5.3 m. Arriving at flux bath 4, there is first a fall (part 28) so that the objects enter flux bath 4 gradually. At the position of part 29 there is a horizontal displacement, while at the position of part 30 there is once again a rise in order to lift the objects gradually out of flux bath 4. After being dried in drier 5, there is a fall, a horizontal displacement and a rise at the respective parts 31, 32 and 33, so that the relevant object is pulled gradually through the galvanizing bath 6. In similar manner there is a fall, a horizontal displacement and a rise of the object at the parts 33, 34 and 35 of rail 20 in order to cool and optionally provide the object with brightener. Finally, at part 36 there is a fall from about 5.3 m to 3.0 m, so that at the end point the objects can be easily removed from the relevant suspension element 22 (arrow $P_3$).

The running time of the system, i.e. the period of time between fastening of an object for treating to a suspension element and the removal of a treated object from the suspension element, amounts in the shown embodiment to about 1.5 hours, while the capacity is variable between about 3000 and 3750 kg per hour.

Figure 3:
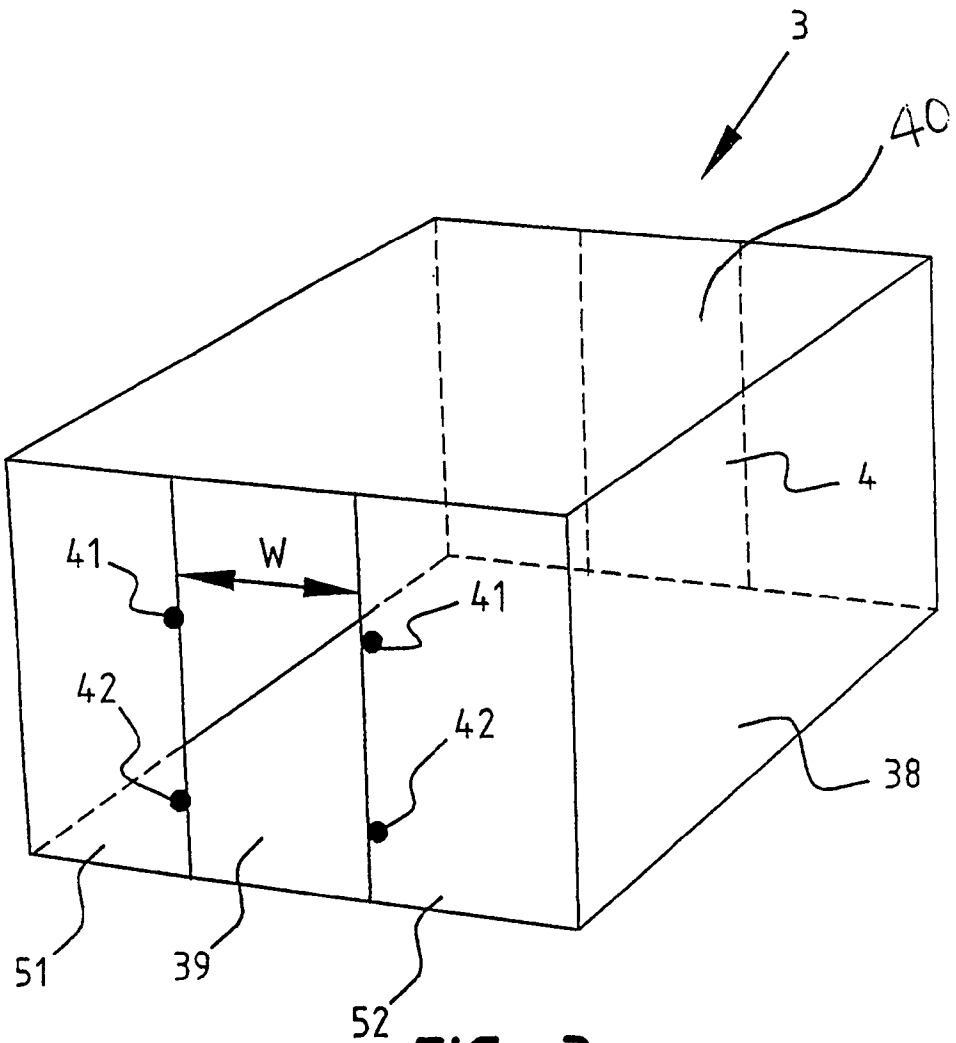
FIG. 3 shows a schematic perspective view of an embodiment of a blasting cabinet according to the invention.

FIG. 3 shows an exemplary embodiment of the blasting cabinet 3. The blasting cabinet 3 is constructed from a casing 38 provided with an entrance opening 39 and an exit opening 40. The objects V can be carried inside via the entrance opening 39 and carried out again via the exit opening 40. In order to ensure that the fewest possible grains escape from the casing 38, the form of the entrance and exit openings 39, 40 can be adapted to the form of the objects being treated at that moment. In the case of voluminous objects the entrance and exit openings 39, 40 are enlarged to, for instance, a width W of 60 cm, while for smaller objects, the openings 39, 40 can be made smaller to, for instance, a width W of about 20 cm.

In the shown embodiment a number of detection eyes 41 are arranged which detect the presence or absence of an object V on a suspension element 22 (shown in FIGS. 1-2*b*). Depending on whether or not an object is detected, a central control (not shown) of the device can control the transport of suspension elements 22 and/or the operation of blasting cabinet 3. It is also possible to control the other elements of the system subject to the detection result, i.e. among others the flux bath 8 and the galvanizing bath (not shown). This allows (fully) automatic galvanizing of the objects.

In another embodiment a number of detection eyes 42 are arranged with which can be determined the dimensions of the object which is about to enter blasting cabinet 3 at that moment. The gap W can then be adjusted depending on the dimensions of the object, for instance by sliding the sliding doors 51 and 52 relative to each other.

Figure 4:
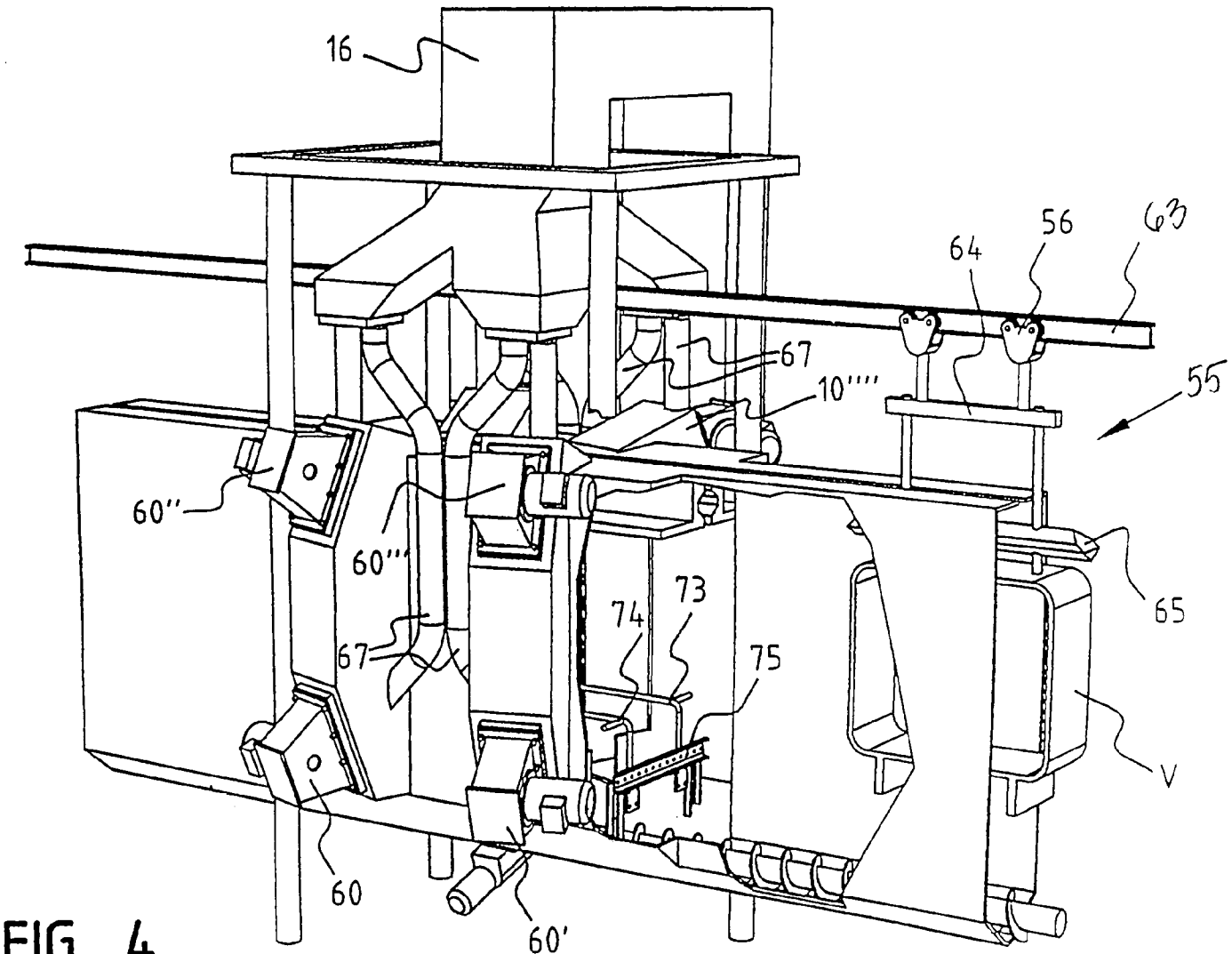
FIG. 4 shows a detailed and partially cut-away perspective view of the blasting cabinet of FIG. 3.
Figure 5:
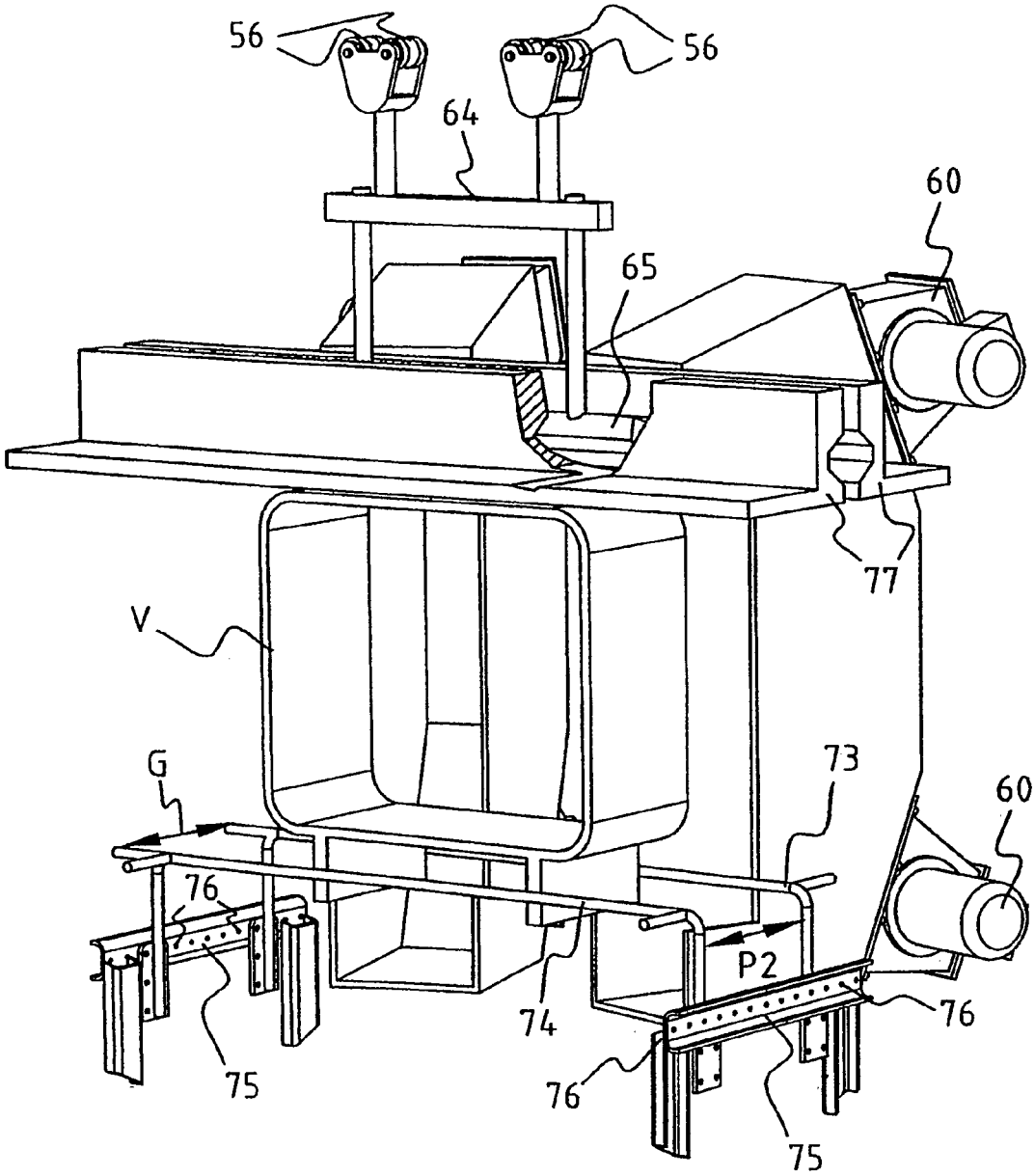
FIG. 5 shows a further cut-away perspective view of the blasting cabinet of FIG. 3 in which the guiding of the objects is further illustrated.

In FIGS. 4 and 5 the embodiment of the shot-blasting device 3 is shown in more detail. Suspension element 55 comprises a number of rollers 56 and a frame 64. An object V is hung on the frame 64. Suspension element 55 is displaceable by its rollers 56 along a track 63. In order to hold the object in an upright position when the shot-blasters 60-60''' are hurling streams of grains against the object with great force, there is provided an upper and a lower guiding. At the top the guiding consists of a beam 65 which can be guided in a slot in a component 77 of the blasting cabinet. The slot is dimensioned herein such that beam 65 is displaceable thereby in longitudinal direction, while too great a-displacement in transverse direction is prevented. The guiding on the underside of object V comprises a first guide rail 73 and a second guide rail 74, wherein the second guide rail 74 extends parallel to and at a mutual spacing G relative to the first guide rail. During the transport along the path through the cabinet the lower part of object V is enclosed between the two guide rails 73 and 74. The choice of distance G is slightly greater here than the relevant dimension of the object (in the shown embodiment the depth of the object V). The distance G can be chosen, for example, to be a maximum of 10 cm greater than the relevant dimension of the object, so that the object V can only be displaced a few centimeters in transverse direction (transverse direction $P_2$) under the influence of the blasting grains.

The mutual spacing G between guide rails 73 and 74 can be adapted to the dimensions of object V. Guide rails 73, 74 are arranged for this purpose on supports 75. Supports 75 are provided with a large number of openings 76 into which the guide rails 73, 74 can be screwed fixedly.

In a further exemplary embodiment the shot-blasting capacity and/or the running speed can be adjusted. Depending on the degree of rust formation on the objects for treating, the shot-blasting capacity (the quantity of grains per unit of time, the blasting angles, the force with which the grains strike the objects etc.) can be varied subject to the running speed of the transport system. This can take place for instance by making use of a frequency control mechanism (not shown).

The suspension elements is able to change position in fully automatic manner during the displacement along the transport system, so the quality of the zinc layer is enhanced and the running speed is high. The position of the suspension hooks is adapted subject to the process an object is undergoing at a given position and a given moment in the transport system. The position of the suspension hooks (length about 60 cm) is adapted by providing at the correct positions in the transport system automatic rotation points which cause a suspension hook to change position as it is transported therealong.

In another exemplary embodiment of the present invention not shown in the figures, a conveyor track of another type is provided. In this conveyor track the objects for galvanizing, after a substantially horizontal displacement along the conveyor track, are moved downward substantially vertically into the flux bath, the galvanizing bath or the cooling bath. After a given time the object is once again moved substantially vertically upward, whereafter the substantially horizontal displacement of the object is continued. This embodiment has the advantage that the height required for the conveyor track is smaller than is the case in the previously mentioned conveyor track. Application of a conveyor track according to the present embodiment further means that the diverse baths do not require as long of a form, since a horizontal displacement of the object in the relevant bath does not have to be taken into account. The capacity of the system can hereby increase to about 5500 kg processed material per hour.

The present invention is not limited to the above described preferred embodiments thereof; the rights sought are defined by the following claims, within the scope of which many modifications can be envisaged.

The invention claimed is:

1. A system for thermally galvanizing an object comprising:

an overhead track provided with a suspension element from which said object can be suspended;

drive means for displacing the suspension element along the overhead track;

one or more shot-blasters for hurling grains in the direction of said object suspended along the overhead track and displaced there-along for the purpose of removing at least a surface layer from said object;

a flux bath for fluxing said object when it is displaced by drive means along the overhead track through the flux bath;

a galvanizing bath for thermally galvanizing said object when it is displaced by the drive means along the overhead track through the galvanizing bath; and a control of the drive means for actuation thereof for substantially uninterrupted transport of said object at a substantially constant speed through at least one of the flux bath or the galvanizing bath.

2. The system as claimed in claim 1, wherein the one or more shot-blasters are disposed to blast said object for treating at a plurality of predetermined blasting angles.

3. The system as claimed in claim 2, wherein the one or more shot-blasters are disposed in a casing having an entrance opening and an exit opening, the dimensions of the entrance opening and exit opening adjustable depending on the form and dimensions of said object when said object is within the casing.

4. The system as claimed in claim 1, wherein the overhead track comprises at least one descending part and at least one ascending part for respectively carrying said object downward into the flux or galvanizing bath and upward out of the flux or galvanizing bath.

5. The system as claimed in claim 1, further comprising:

detection means for detecting said object hanging from the suspension element; and control means for controlling the drive means of the overhead track and the one or more shot-blasters in order to interrupt the driving of the suspension element and the shot-blasters with a predetermined time delay.

6. The system as claimed in claim 1, comprising:

means for drying said object, and means for cooling said object or burnishing said object, or both.

7. The system as claimed in claim 1, further comprising cleaning means, between the one or more shot blasters and the flux bath, for substantially cleaning by blowing said object with air or removing material residues from said object with liquid, or both.

8. The system as claimed in claim 7, further comprising:

collecting means for collecting a mixture of material residues with air, liquid, or both;

means for separating the material residues; and means for feeding the air, the liquid, or both back to the cleaning means.

9. The system as claimed in claim 1, wherein means are disposed at a position beyond the galvanizing bath for guiding air along said object so as to blow off zinc droplets on said object.

10. The system as claimed in claim 1, wherein the suspension element is manufactured from an alloy characterized in that substantially no zinc is absorbed or adheres to a surface of the suspension element.

* * * * *